US005494601A

United States Patent [19]

Flynn et al.

[11] Patent Number: 5,494,601

[45] Date of Patent: Feb. 27, 1996

[54] AZEOTROPIC COMPOSITIONS

[75] Inventors: Richard M. Flynn, Mahtomedi; Daniel R. Vitcak, Oakdale, both of Wash.

[73] Assignee: Minnesota Mining and Manufacturing Company, St. Paul, Minn.

[21] Appl. No.: 41,686

[22] Filed: Apr. 1, 1993

[51] Int. Cl.[6] ..... C11D 7/30; C11D 7/50

[52] U.S. Cl. ..... 252/171; 134/40; 252/67; 252/170; 252/364; 252/DIG. 9; 264/53; 264/DIG. 5

[58] Field of Search ..... 252/162, 170, 252/171, 364, DIG. 9, 67; 134/40; 264/53, DIG. 5

[56] References Cited

U.S. PATENT DOCUMENTS

| | | | |
|---|---|---|---|
| 3,101,304 | 8/1963 | Wiist | 202/39.5 |
| 3,449,218 | 6/1969 | Jaeger | 203/44 |
| 3,904,430 | 9/1975 | Tipping et al. | 134/11 |
| 3,957,531 | 5/1976 | Tipping et al. | 134/11 |
| 4,035,250 | 7/1977 | Walters et al. | 204/59 F |
| 4,092,257 | 5/1978 | Fozzard | 252/66 |
| 4,169,807 | 11/1979 | Zuber | 252/171 |
| 4,971,716 | 11/1990 | Batt et al. | 252/171 |
| 4,994,202 | 2/1991 | Merchant | 252/172 |
| 5,037,572 | 8/1991 | Merhant | 252/171 |
| 5,055,138 | 10/1991 | Slinn | 134/11 |
| 5,064,560 | 11/1991 | Merchant | 252/171 |
| 5,073,288 | 12/1991 | Anton | 252/162 |
| 5,073,290 | 12/1991 | Anton | 252/162 |
| 5,082,503 | 1/1992 | Sluga et al. | 134/26 |
| 5,089,152 | 2/1992 | Flynn et al. | 252/194 |
| 5,091,104 | 2/1992 | Van der Puy | 252/171 |
| 5,102,563 | 4/1992 | Desbiendras et al. | 252/171 |
| 5,129,997 | 7/1992 | Shottle et al. | 203/99 |
| 5,143,652 | 9/1992 | Slinn | 252/602 |
| 5,162,384 | 11/1992 | Owens | 521/110 |
| 5,166,182 | 11/1992 | Blanpied | 521/50 |
| 5,176,757 | 1/1993 | Anton | 134/42 |
| 5,221,492 | 6/1993 | Bartlett | 252/67 |

FOREIGN PATENT DOCUMENTS

| | | |
|---|---|---|
| 0427604A1 | 11/1990 | European Pat. Off. . |
| 465037 | 1/1992 | European Pat. Off. . |
| WO93/05200 | 3/1993 | WIPO . |

OTHER PUBLICATIONS

Database WPI, Derwent Publications Ltd., London, GB; AN 89–112335 & JP,A,1 060 694 (Daikin Kogyo KK) 7 Mar. 1989.

Database WPI, Derwent Publications Ltd., London, GB; AN 93–247652 & JP,A,5 168 807 (Daikin Kogyo KK). Jul. 1993.

Database WPI, Derwent Publications Ltd., London, GB; AN 86–222046 & JP,A,61 152 786 (Asahi Glass KK) 11 Jul. 1986.

*Primary Examiner*—Linda Skaling

*Attorney, Agent, or Firm*—Gary L. Griswold; Walter N. Kirn; Eloise J. Maki

[57] ABSTRACT

Azeotropic compositions include a perfluorinated alkane or alkene and an organic solvent.

3 Claims, No Drawings

AZEOTROPIC COMPOSITIONS

The invention relates to azeotropes.

BACKGROUND OF THE INVENTIONS

Chlorofluorocarbons (CFCs) and hydrochlorofluorocarbons (HCFCs) have been used commonly in a wide variety of solvent applications such as drying, cleaning (e.g., the removal of flux residues from printed circuit boards), and vapor degreasing. CFCs and HCFCs also commonly have been used as physical blowing agents to generate cells in foamed plastic materials. However, CFCs and HCFCs have been linked to the destruction of the earth's protective ozone layer, and replacements have been sought. The characteristics sought in replacements, in addition to low ozone depletion potential, typically have included low boiling point, low flammability, and low toxicity. Solvent replacements also should have a high solvent power.

It is known that azeotropes possess some properties that make them useful solvents. For example, azeotropes have a constant boiling point, which avoids boiling temperature drift during processing and use. In addition, when a volume of an azeotrope is used as a solvent, the properties of the solvent remain constant because the composition of the solvent does not change. Azeotropes that are used as solvents also can be recovered conveniently by distillation.

A number of examples of azeotropic, and azeotrope-like, compositions that include a perfluorinated compound and an organic solvent are known in the art.

Zuber, U.S. Pat. No. 4,169,807 describes an azeotropic composition containing water, isopropanol, and either perfluoro-2-butyltetrahydrofuran or perfluoro-1,4-dimethylcyclohexane. The inventor states that the composition is useful as a vapor phase drying agent.

Van der Puy, U.S. Pat. No. 5,091,104, describes an "azeotropic-like" composition containing t-butyl-2,2,2-trifluoroethyl ether and perfluoromethylcyclohexane. The inventor states that the composition is useful for cleaning and degreasing applications.

Fozzard, U.S. Pat. No. 4,092,257 describes an azeotrope containing perfluoro-n-heptane and toluene.

Batt et al., U.S. Pat. No. 4,971,716 describes an "azeotrope-like" composition containing perfluorocyclobutane and ethylene oxide. The inventor states that the composition is useful as a sterilizing gas.

Shottle et al., U.S. Pat. No. 5,129,997 describes an azeotrope containing perfluorocyclobutane and chlorotetrafluorethane.

Merchant, U.S. Pat. No. 4,994,202 describes an azeotrope containing perfluoro-1,2-dimethylcyclobutane and either 1,1-dichloro-l-fluoroethane or dichlorotrifluoroethane. The inventor states that the azeotrope is useful in solvent cleaning applications and as blowing agents. The inventor also notes that "as is recognized in the art, it is not possible to predict the formation of azeotropes. This fact obviously complicates the search for new azeotrope compositions" (col. 3, lines 9–13).

Azeotropes including perfluorohexane and hexane, perfluoropentane and pentane, and perfluoroheptane and heptane are also known.

There currently is a need for alternative azeotrope compositions that can be used in solvent and other applications. Preferably these compositions would be non-flammable, have good solvent power, and cause little, if any, damage to the ozone layer. Preferably, also, the azeotrope composition would consist of readily available and inexpensive solvents.

SUMMARY OF THE INVENTION

The invention features various azeotropic compositions that include a perfluorinated alkane or alkene and at least one organic solvent. The azeotropic compositions exhibit good solvent properties and, as a result, can replace CFCs and HCFCs in solvent applications in which low boiling CFCs and HCFCs are used. The preferred compositions are non-flammable and typically have boiling points lower than both the perfluorinated compound and the organic solvent. The preferred compositions cause only limited, if any, ozone depletion, and also have low toxicity.

One featured azeotropic composition includes a non-cyclic perfluorinated alkane and a hydrochlorofluorocarbon (HCFC) solvent. For this composition, the preferred perfluorinated alkanes are perfluoropentane and perfluorohexane, and the preferred HCFCs are 1,1,1-trifluoro-2,2-dichloroethane and 1,1-dichloro- 1-fluoroethane.

Another featured azeotrope composition includes a non-cyclic perfluorinated alkane and a hydrofluorocarbon (HFC) solvent. For this composition, the preferred perfluorinated alkane is perfluorohexane and the preferred solvent is 1,1,2,2-tetrafluorocyclobutane.

Another featured azeotropic composition includes a perfluorinated alkane and a siloxane solvent. For this featured composition, the preferred perfluorinated alkanes are perfluorohexane and perfluoro-2-methylpentane; the preferred siloxane solvent is hexamethyldisiloxane.

Another featured azeotropic composition includes a non-cyclic, perfluorinated alkane and a non-cyclic ether solvent. For this composition, the preferred perfluorinated alkanes are perfluoropentane and perfluorohexane, and the preferred ethers are t-butyl methyl ether and t-amyl methyl ether.

Another featured azeotropic composition includes perfluoropentane and heptane.

Another featured azeotropic composition includes perfluoropentane and 2,3-dimethylbutane.

Another featured azeotropic composition includes perfluoropentane and hexane.

Another featured azeotropic composition includes perfluorohexane and 2,3-dimethylpentane.

Another featured azeotropic composition includes perfluorohexane and 2,2,4-trimethylpentane.

Another featured composition includes a perfluorinated alkene and an ether solvent. For this composition, the preferred perfluorinated alkenes are perfluoro-2-methyl-2-pentene and perfluoro-4-methyl-2-pentene, and the preferred ether solvent is t-amyl methyl ether.

"Azeotropic composition", as used herein, is a mixture of the perfluorinated alkane or alkene and one or more organic solvents, in any quantities, that if fractionally distilled will produce a distillate fraction that is an azeotrope of the perfluorinated compound and the organic solvent(s). The characteristics of azeotropes are discussed in detail in Merchant, U.S. Pat. No. 5,064,560 (see, in particular, col. 4, lines 7–48), which is hereby incorporated by reference.

"Perfluorinated alkane" and "perfluorinated alkene", as used herein, is an alkane or alkene, respectively, in which all of the hydrogen atom bonding sites on the carbon atoms in the molecule have been replaced by fluorine atoms, except for those sites where substitution of a fluorine atom for a hydrogen atom would change the nature of the functional group present (e.g., conversion of an aldehyde to an acid fluoride).

A HCFC is a compound consisting only of carbon, fluorine, chlorine, and hydrogen. A HFC is a compound consisting only of carbon, hydrogen, and fluorine. A hydrocarbon is a compound consisting only of carbon and hydrogen. All of these compounds can be saturated or unsaturated, branched or unbranched, and cyclic or acyclic.

The invention also features azeotropes including the components of the azeotropic compositions described above.

The azeotropic compositions are suitable for a wide variety of uses in addition to solvent applications. For example, the compositions can be used as blowing agents, as carrier solvents for lubricants, in cooling applications, for gross leak testing of electronic components, and for liquid burn-in and environmental stress testing of electronic components.

Other features and advantages of the invention will be apparent from the description of the preferred embodiments thereof, and from the claims.

DESCRIPTION OF THE PREFERRED EMBODIMENT

The preferred perfluorinated alkanes and alkenes are acyclic and consist only of carbon and fluorine atoms. The compounds preferably have a boiling point of less than 125° C., and include between 2 and 12 carbon atoms, more preferably between 4 and 8 carbon atoms. Examples of perfluorinated alkanes and alkenes include perfluoropentane, perfluorohexane, perfluoro-2-methylpentane, perfluoro-2-methyl-2-pentene, and perfluoro-4-methyl-2-pentene. The compounds are commercially available or Known in the literature.

The preferred organic solvents include HCFCs (e.g., 1,1,1-trifluoro-2,2-dichloroethane 1,1-dichloro-2,2,3,3,3-pentafluoropropane, 1,3-dichloro-1,1,2,2,3-pentafluoropropane, and 1,1-dichloro-l-fluoroethane), HFCs (e.g., 1,1,2-trifluoroethane, 1,1,2,2-tetrafluorocyclobutane, 1-hydro-perfluoropentane, 1-hydro-perfluorohexane, 2,3-dihydro-perfluoropentane, and 2,2,3,3-tetrahydro-perfluorobutane), siloxanes (e.g., hexamethyldisiloxane), ethers (e.g., tetrahydrofuran, t-butyl methyl ether, and t-amyl methyl ether), or hydrocarbons (e.g, heptane, hexane, isooctane, 2,3-dimethylbutane, 2,3-dimethylpentane, cyclopentane, and 2,2,4-trimethylpentane). The solvent typically has a boiling point of between 20° C. and 125° C,. and preferably has a boiling point within about 40° C. of the perfluorinated compound used in the composition. Where flammability is a concern, the boiling point of the solvent more preferably is within about 25° C. to 40° C. higher than the boiling point of the perfluorinated compound. The solvent preferably includes between 1 and 12 carbon atoms.

The preferred azeotropic compositions preferably include about the same quantities, by weight, of the perfluorinated alkane or alkene and the organic solvent(s) as the azeotrope formed between them. This in particular avoids significant boiling temperature drift and significant change in solvent power of the composition when the composition is used as a solvent. Preferably, the quantity, by weight, of the perfluorinated alkane or alkene and the organic solvent in the azeotropic composition is within 10%, and more preferably within 5%, of the average quantities of the perfluorinated alkane or alkene and the solvent found in the azeotrope formed between them. Thus, for example, if an azeotrope between a particular perfluorinated alkane or alkene and an organic solvent contains on average 60% by weight of the perfluorinated alkane or alkene and on average 40% by weight of the solvent, the preferred azeotropic composition includes between 54% and 66% (more preferably between 57% and 63%) of the perfluorinated alkane or alkene by weight, and between 36% and 44% (more preferably between 38% and 42%) of the solvent by weight. The same general guidelines apply when an azeotrope includes more than one organic solvent.

The more preferred azeotropic compositions are a single phase under ambient conditions, i.e., at room temperature and atmospheric pressure.

To determine whether a particular combination of a perfluorinated alkane or alkene and organic solvent will form an azeotrope, the particular combination can be screened by methods known in the art. For example, a composition can be carefully distilled through a four foot, perforated plate internal bellows silvered column of 45 physical plates or, alternatively, a six plate Snyder column. The initial distillate is collected and analyzed by GLC, e.g., using a three foot Porapak P or a six foot Hayesep Q column and a thermal conductivity detector with the appropriate corrections for thermal conductivity difference between the components. In some cases a second distillation using the composition determined in the first distillation may be carried out and the composition of the distillate analyzed at intervals over the course of the distillation. If a solvent mixture is found to form a azeotrope, the composition of the azeotrope can be determined by known methods.

Examples of the azeotropes of the invention are provided in Table 1. In Table 1, component A is the perfluorinated compound, and component B is the organic solvents. The compositions are provided in weight percents. Flammability was determined either by measurement of the flash point according to ASTM test method D-3278-89, or by contact with an ignition source.

TABLE 1

| Example | Component A | Component B | Azeotropic Composition (A:B) | Azeotrope (A:B) | Boiling Point | Flammable |
|---|---|---|---|---|---|---|
| 1 | perfluoropentane | 1,1,1-trifluoro-2,2-dichloroethane | 50/50 | 55/45 | 20° C. | no |
| 2 | perfluoropentane | t-butyl methyl ether | 50/50 | 90/10 | 25° C. | no |
| 3 | perfluoropentane | heptane | 50/50 | 99.9/0.1 | 29° C. | no |
| 4 | perfluorohexane | 1,1,1-trifluoro-2,2-dichloroethane | 50/50 | 12/88 | 26–27° C. | no |
| 5 | perfluorohexane | 1,1-dichloro-1-fluoroethane | 50/50 | 42/58 | 26° C. | no |

TABLE 1-continued

| Example | Component A | Component B | Azeotropic Composition (A:B) | Azeotrope (A:B) | Boiling Point | Flammable |
|---|---|---|---|---|---|---|
| 6 | perfluorohexane | 1,1,2,2-tetrafluoro-cyclo-butane | 57/43 | 62/38 | 39–41° C. | no |
| 7 | perfluoropentane | 2,3-dimethylbutane | 90/10 | 92/8 | 28° C. | no |
| 8 | perfluoropentane | hexane | 92/8 | 95/5 | 29° C. | no |
| 9 | perfluorohexane | hexamethyl-disiloxane | 92/8 | 93/7 | 57° C. | no |
| 10 | perfluoro-2-methylpentane | hexamethyl-disiloxane | 93/7 | 93/7 | 57° C. | no |
| 11 | mixture of perfluoro-2-methyl-2-pentene and perfluoro-4-methyl-2-pentene | t-amyl methyl ether | 90/10 | 95/5 | 46° C. | no |
| 12 | perfluorohexane | t-amyl methyl ether | 90/10 | 90/10 | 53° C. | no |
| 13 | perfluorohexane | 2,3-dimethyl-pentane | 90/10 | 92/8 | 56° C. | no |
| 14 | perfluorohexane | 2,2,4-tri-methylpentane | 95/5 | 95/5 | 57° C. | no |

The azeotropic compositions of the invention can be used in a variety of applications. For example, the azeotropic compositions can be used to clean electronic articles such as printed circuit boards, magnetic media, disk drive heads and the like, and medical articles such as syringes and surgical equipment. The contaminated articles may be cleaned by contacting the article with the azeotropic composition, generally while the composition is boiling or otherwise agitated. The azeotropic compositions can be used in a variety of specific cleaning procedures, such as those described in Tipping et al., U.S. Pat No. 3,904,430; Tipping et al., U.S. Pat. No. 3,957,531; Slinn, U.S. Pat. No. 5,055,138; Sluga et al., U.S. Pat. No. 5,082,503; Flynn et al., U.S. Pat. No. 5,089,152; Slinn, U.S. Pat. No. 5,143,652; and Anton, U.S. Pat. No. 5,176,757, all of which are hereby incorporated by reference herein.

The cleaning ability of a preferred azeotrope (Example 12 in Table 1) was evaluated by ultrasonically washing coupons of various materials. Ultrasonic washing was performed in a Branson 1200 ultrasonic bath at 19.4° C. by immersing the coupon in the solvent. The coupons were parallelepiped approximately 2.5 mm×5 mm ×1.6 mm of 316 stainless steel, copper, aluminum, carbon steel, acrylic, or a printed-circuit board. Initially, coupons were cleaned with Freon 113 and then weighed to ±0.0005 g. A coupon was soiled by immersing a portion of it in the soil (Medi Kay heavy mineral oil, light machine oil, heavy machine oil, bacon grease, or Alpha 611 solder flux), removing it from the soil and weighing it. The soiled coupon was then cleaned by ultrasonic washing for 30 s and then weighed. Next, the coupon was then cleaned for an additional 30 s and then weighed. Finally, the coupon was cleaned for an additional 2 min and weighed. Weight of soil removed as a percentage of that loaded (determined by difference) is reported in Tables 2–5 for a total cleaning time of 3 min. The Freon 113 is included for comparative purposes. For some of the coupons the results show that greater than 100% of the contaminant was removed. It is believed that this may be because the initial cleansing with Freon 113 did not remove all of the contaminant that was originally on the coupons.

TABLE 2

| % MINERAL OIL REMOVED FROM COUPONS AT 3 MINUTES | | | | | | |
|---|---|---|---|---|---|---|
| Coupon | Carbon S | Copper | SS | Alum | PCB | Acrylic |
| Solvent Freon 113 | 100 | 100 | 100 | 100 | N/A | 100 |
| Example 12 | 100 | 100 | 100 | 100 | N/A | 99 |

TABLE 3

| % BACON GREASE REMOVED FROM COUPONS AT 3 MINUTES | | | | | | |
|---|---|---|---|---|---|---|
| Coupon | Carbon S | Copper | SS | Alum | PCB | Acrylic |
| Solvent Freon 113 | 101 | 100 | 100 | 100 | N/A | 100 |
| Example 12 | 100 | 100 | 102 | 100 | N/A | 100 |

TABLE 4

| % LIGHT OIL REMOVED FROM COUPONS AT 3 MINUTES | | | | | | |
|---|---|---|---|---|---|---|
| Coupon | Carbon S | Copper | SS | Alum | PCB | Acrylic |
| Solvent Freon 113 | 100 | 100 | 100 | 100 | N/A | 100 |
| Example 12 | 101 | 101 | 101 | 101 | N/A | 100 |

TABLE 5

| % HEAVY MACHINE OIL REMOVED FROM COUPONS AT 3 MINUTES | | | | | | |
|---|---|---|---|---|---|---|
| Coupon | Carbon S | Copper | SS | Alum | PCB | Acrylic |
| Solvent Freon 113 | 100 | 100 | 100 | 100 | N/A | 100 |
| Example 12 | 101 | 100 | 100 | 100 | N/A | 100 |

An azeotrope having the composition of example 12 of Table 1 was used as the solvent in a water displacement application described in Flynn, U.S. Pat. No. 5,089,152 ("Flynn"), which was previously incorporated by reference. The azeotrope was used in the procedure described in example 1 of Flynn, using a 0.2% by weight of the amidol surfactant in example 2a in Table 1 of Flynn, and was found to be effective in displacing water.

Some of the azeotropic compositions of the present invention are useful for cleaning sensitive substrates such as films, including coated films and film laminates. Many such films are sensitive to organic solvents and water, which can dissolve or degrade the film, or the coating. Thus, the azeotropic compositions that are used to clean films preferably include organic solvents that do not cause degradation of the film or coating. Examples of organic solvents that are suitable for film-cleaning applications include t-amyl methyl ether, hexamethyldisiloxane, isooctane, t-butanol, and 2,3-dimethylpentane.

A sample of exposed photographic film was marked on both sides (coated and uncoated sides) with a grease pencil. The sample was then suspended in the vapor above a boiling sample of the azeotropic composition of Example 9 for a period of 30 seconds. The film was then wiped using a cotton or paper pad to remove residual amounts of the azeotropic composition and marking. The film sample was then visually inspected to reveal only a slight residue of the marking from the grease pencil. Both sides were cleaned equally and there appeared to be no degradation of either the film or the photographic emulsion.

This test was then repeated using another sample of exposed, marked photographic film. The film was placed in the vapor above a boiling sample of the azeotropic composition of Example 12. Visual inspection of the sample revealed complete removal of the grease pencil marking. There was no apparent damage to either the film or the emulsion.

Another sample of exposed, marked photographic film was contacted with the azeotropic composition of Example 12, at room temperature. After one minute the sample was removed, wiped as before, and visually inspected. The sample revealed no traces of the grease pencil, and no apparent damage to either the film or the emulsion.

The azeotropic compositions also can be used as blowing agents, according to the procedures described in Owens et al., U.S. Pat. No. 5,162,384, which was previously incorporated by reference herein.

Other embodiments are within the claims.

What is claimed is:

1. An azeotropic composition consisting essentially of:

(A) 81 to 99 weight percent of an acyclic perfluorinated alkane selected from the group consisting of perfluorohexane and perfluoropentane; and (B) 1 to 19 weight percent of an acyclic ether solvent, which solvent is t-amyl methyl ether if the acyclic perfluorinated alkane is perfluorohexane, and t-butyl methyl ether if the perfluorinated acyclic alkane is perfluoropentane;

such that the composition, when fractionally distilled, will yield a distillate fraction that is an azeotrope, the azeotrope:

(i) consisting essentially of 90 weight percent acyclic perfluorinated alkane and 10 weight percent acyclic ether; and (ii) having a boiling point of 53° C. at ambient pressure, when the acyclic perfluorinated alkane is perfluorohexane, or, when the acyclic perfluorinated alkane is perfluoropentane, a boiling point of 25° C. at ambient pressure.

2. An azeotropic composition according to claim 1, wherein the composition consists essentially of:

(A) 85 to 95 weight percent of an acyclic perfluorinated alkane, and (B) 5 to 15 weight percent of an acyclic ether solvent.

3. An azeotropic composition according to claim 1 which is an azeotrope and consists essentially of 90 wt. % of acyclic perfluorinated alkane and 10 wt. % of acyclic ether, wherein the acyclic perfluorinated alkane is selected from the group consisting of perfluorohexane and perfluoropentane, and the acyclic ether is t-amyl methyl ether if the acyclic perfluorinated alkane is perfluorohexane, and is t-butyl methyl ether if the acyclic perfluorinated alkane is perfluoropentane, and which composition boils at 53° C. at ambient pressure where the acyclic perfluorinated alkane is perfluorohexane and 25° C. at ambient pressure where the acyclic perfluorinated alkane is perfluoropentane.

* * * * *